US006720932B1

(12) United States Patent
Flynn et al.

(10) Patent No.: US 6,720,932 B1
(45) **Date of Patent: *Apr. 13, 2004**

(54) MULTI-FREQUENCY ANTENNA FEED

(75) Inventors: Stephen John Flynn, Thatcham (GB); Gerard King, Reading (GB); Andrew Patrick Baird, Bramley (GB); Jamie Stokes, Reading (GB)

(73) Assignee: Channel Master Limited, Berkshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 56 days.

(21) Appl. No.: 09/869,728

(22) PCT Filed: Jan. 7, 2000

(86) PCT No.: PCT/GB00/00019

§ 371 (c)(1),
(2), (4) Date: Sep. 19, 2001

(87) PCT Pub. No.: WO00/41266

PCT Pub. Date: Jul. 13, 2000

(30) Foreign Application Priority Data

Jan. 8, 1999 (GB) ..... 9900411

(51) Int. Cl.[7] ..... H01Q 13/00
(52) U.S. Cl. ..... 343/786; 343/840; 333/21 A
(58) Field of Search ..... 343/785, 786, 343/840; 333/21 A, 208, 126, 135, 248

(56) References Cited

U.S. PATENT DOCUMENTS

| | | | | | |
|---|---|---|---|---|---|
| 4,200,870 | A | * | 4/1980 | Gabbitas | 382/114 |
| 4,819,005 | A | | 4/1989 | Wilkes | 343/786 |
| 5,005,023 | A | | 4/1991 | Harris | 343/756 |
| 5,041,840 | A | * | 8/1991 | Cipolla et al. | 343/700 MS |
| 5,066,959 | A | * | 11/1991 | Huder | 333/117 |
| 5,103,237 | A | | 4/1992 | Weber | 343/786 |
| 5,461,394 | A | * | 10/1995 | Weber | 343/776 |
| 5,517,203 | A | * | 5/1996 | Fiedziuszko | 333/202 |
| 5,552,797 | A | * | 9/1996 | Cook | 343/786 |
| 5,907,309 | A | * | 5/1999 | Anderson et al. | 333/248 |
| 6,323,819 | B1 | * | 11/2001 | Ergene | 333/134 |

FOREIGN PATENT DOCUMENTS

| | | |
|---|---|---|
| WO | WO 9222938 A | 12/1992 |
| WO | WO 9628857 A | 9/1996 |
| WO | WO 9810479 A | 3/1998 |
| WO | WO 9963624 A | 12/1999 |

OTHER PUBLICATIONS

Chang S. Kim, "Dual Bank Coaxial Feedhorn Design", International Symposium on Antennas and Propogation, US, New York, 1990, pp. 952–955, XP000167426 p. 1, figure 1.

* cited by examiner

*Primary Examiner*—Tan Ho
(74) *Attorney, Agent, or Firm*—Gifford, Krass, Groh, Sprinkle, Anderson & Citkowski, P.C.

(57) ABSTRACT

A multi-frequency antenna feed for incorporation into a single unit which combines at least two waveguides to provide simultaneous reception and/or transmission of signals in at least two separate frequency bands is described.

This is achieved by creating a waveguide system of at least two waveguides sharing the same central axis; a central conventional waveguide which also acts as a center conductor for an outer coaxial waveguide and feeding the outer coaxial waveguide from a non-circular side feed, orthogonal to the waveguide axis, to set up a uniform field in the outer coaxial waveguide. The feeds are adjusted so that the phase center for each frequency band is at the same point in the feed for the same dish. Various embodiments of the invention are described.

44 Claims, 10 Drawing Sheets

MULTI-FREQUENCY ANTENNA FEED

FIELD OF THE INVENTION

The present invention relates to a multi-frequency antenna feed for use in providing the simultaneous reception and/or transmission of signals in at least two separate frequencies bands. The invention also relates to an apparatus and to a method of transmitting and/or receiving multiple frequency bands in a single antenna feed.

BACKGROUND OF THE INVENTION

Existing antenna feeds as used in low noise blocks (LNBs) allow communication with satellites generally permit communication over a single frequency band as disclosed in applicant's U.S. Pat. No. 5,619,173. Although the disclosed LNB works well it is nevertheless limited to a single continuous frequency band.

One of the satellite systems presently attracting interest is the Astra Return Channel System (ARCS). This involves reception from the Astra satellite system at the existing Ku-band frequencies (10.7–12.75 GHz) in both horizontal and vertical linear polarities and transmission back to satellite at Ka band (29.5–30 GHz) on a single linear polarity. Although the Astra system receives at Ku and transmits at Ka band, it is desirable to provide a system which operates equally well for reception in both bands, transmission in both bands or transmission at Ku and reception at Ka bands. Other two-way satellite communication systems around the world are proposing different frequency bands to the Astra system such as reception at one frequency band, for example 20 GHz, and transmission at a different frequency band, for example 30 GHz. For transmission or reception in widely spaced separate frequency bands using a single dish, the dish feeds for the two bands must share the same focal point. To date this has been achieved by using a coaxial waveguide structure and exciting the coaxial waveguide section with orthogonal waveguide probes (reference U.S. Pat. No. 5,463,407). This however has the disadvantage of setting up uneven fields in the coaxial waveguide which degrades the isolation between the probes and increases the probe loss. The orthogonal orientation of the probes makes it difficult to feed both polarities onto the same circuit board for subsequent processing of the received signal.

An object of the present invention is to provide a multi-frequency antenna feed which obviates or mitigates at least one of the aforementioned disadvantages.

A further object of the present invention is to provide a multi-frequency antenna feed for incorporation into a single unit which combines at least two waveguides to provide simultaneous reception and/or transmission of signals in at least two separate frequency bands.

SUMMARY OF THE INVENTION

This is achieved by creating a waveguide system of at least two waveguides sharing the same central axis; a central conventional waveguide which also acts as a center conductor for an outer coaxial waveguide and feeding the outer coaxial waveguide from an orthogonal non-circular side feed to set up a uniform field in the outer coaxial waveguide. The feeds are adjusted so that the phase center for each frequency band is at the same point in the feed for the same dish.

According to a first aspect of the present invention this is achieved by providing a single antenna feed structure having a first central waveguide operating at a first frequency band and at least one outer waveguide substantially coaxial with the central waveguide and operating at a second frequency band, said first waveguide being excited by excitation means disposed in said waveguide, and said second waveguide being excited by radiation from a non-circular waveguide disposed orthogonally to the longitudinal axis of the outer waveguide so as to set up a uniform field in said at least one outer coaxial waveguide.

Preferably, said antenna feed includes two waveguides, a first central circular waveguide and a second outer larger diameter circular waveguide coaxial with said inner central waveguide. Preferably, first frequency band is higher than the second frequency band. Alternatively, the first frequency band is lower when the central waveguide is dielectrically loaded. Alternatively, the inner waveguide has a square cross-section and the outer waveguide has a square cross-section and is coaxial with the inner waveguide. A further alternative arrangement is provided by a central circular waveguide and an outer square waveguide coaxial with the inner circular waveguide or vice versa. The inner and outer waveguide structures have cross-section which are capable of supporting two orthogonal polarisations. For example, they may be elliptical in cross-section and coaxial.

Preferably, a low pass filter is disposed between the inner and outer waveguide structures to improve signal isolation between said first and said second frequency band. Preferably, said low pass filter is provided by a plurality of spaced ridge portions upstanding from the inner coaxial waveguide.

Conveniently, there are four spaced ridge portions. Preferably also, the four ridge portions are arrange symmetrically in pairs about a plane orthogonal to the waveguide axis.

Preferably, the excitation means is a probe disposed in the central waveguide. Alternatively, the excitation means is selected from a slot radiator, a patch radiator, a dipole, a wire loop excitation probe and disposed in the central waveguide.

Preferably also, said central waveguide is fed by said probe and has a short circuit behind said probe for providing a single polarity system. Alternatively, said central waveguide has two spaced probes separated by an isolation bar, and a twist plate at the end of said waveguide for providing a dual polarity system. A dual polarity system may also be provided by using two orthogonal probes in said inner waveguide.

Preferably, the outermost waveguide is coupled to at least one rectangular waveguide to define a rectangular aperture into the coaxial guide. Conveniently, the field set up in the rectangular waveguide is achieved by using a conventional probe with a short circuit behind the probe at a nominal distance of a quarter wavelength, such that the rectangular aperture feed sets up a uniform field in the second outer coaxial waveguide. Conveniently, two rectangular feed sections are used, one for horizontal polarised signals and one for vertical polarised signals, said feeds being disposed in the same plane parallel to the waveguide axis.

Alternatively, an elliptical waveguide may be coupled to said second outer waveguide instead of a rectangular waveguide, and defining with said second waveguide an elliptical aperture in the wall of said outer waveguide. Two elliptical feed sections oriented in orthogonal directions can be used with one for horizontal signals and one for vertical signals. Alternatively, the elliptical feed sections may be in line.

As a further alternative a circular guide could be used in the side feed with a circular to rectangular or a circular to an elliptical transition to feed a corresponding rectangular or elliptical aperture in the wall of the outer coaxial waveguide.

Preferably, each of the side waveguides has a tuning post disposed therein to improve the match between the side feed waveguide and the coaxial waveguide.

Conveniently, the or each tuning post is cast into the side feed waveguide. Alternatively, the tuning posts are separate and are adjustable relative to the side feed waveguide to improve the match. Preferably, the separate tuning posts are provided by turning screws which are adjustable relative to the side feed waveguide.

The inner central waveguide preferably includes a polyrod lens for beam shaping to match up with a dish. Alternatively, a small feed horn or other type of dielectric lens may be used with the central waveguide in place of the polyrod lens.

An outer coaxial waveguide preferably opens out into a horn feed for illuminating the same dish. The horns/feeds are positioned so that the focal point for each frequency band is at the same point in the feed for the same dish. Alternatively, the horn may be replaced by a cross feed as disclosed in applicant's co-pending published patent application No. W099/63624. Conveniently, the horn may be conical and straight sided or corrugated.

Preferably also, when the antenna feed includes waveguides which are coaxial, an isolation bar is disposed in the outer waveguide and connects between the outer surface of the inner central waveguide and the inner surface of the outer coaxial waveguide on both sides of the inner waveguide and in a plane orthogonal to the two rectangular waveguides. A single isolation bar may be used or two isolation bars next to each other or an isolation plate may be used. The isolation bar/plate serves as a short circuit for each rectangular feed and provides isolation between the two feeds.

Advantageously, a twist plate is disposed at the back of the coaxial waveguide and which extends on each side of the central waveguide. The twist plate is oriented at 45° to the isolation bar and may take the form of any suitable twist plate such as disclosed in applicant's published International Patent Application Nos. WO 96/28857 and WO 96/37041, that is a straight leading edge, a stepped leading edge or combination of a plate and a tapered waveguide. A tapered waveguide as disclosed in applicant's copending application published as WO 92/22938 may be used. The tapered waveguide may be provided by providing cast stepped portions on the inner surface of the outer waveguide, said portions converging towards said inner coaxial waveguide when fitted into said outer coaxial waveguide in the antenna feed structure.

Conveniently, two stepped portions are cast into said outer waveguide.

It will also be appreciated that rectangular waveguides could feed the coaxial waveguide in orthogonal planes thus avoiding the need for a twist plate and isolation bar but making the connection of the two polarities to a circuit board more difficult.

Preferably, said inner coaxial waveguide tube is press-fitted into said outer tube. Preferably, the inner tube has its leading end coated with a conductive elastomer prior to press fitting to minimise any gaps between said inner tube and the base casting at the end of the waveguide assembly. Conveniently, said conductive elastomer is a gasket applied to the end of the inner coaxial waveguide tube.

Waveguide systems may be used which incorporate three or more waveguides, all the waveguides being coaxial with a central waveguide. The central waveguides are circular or square and the outer waveguides also circular or square. The outer waveguides are excited, as described above, by side feeds to create a uniform field in each of the outer coaxial waveguides and have waveguide components, such as probes, twist plates and isolation bars, as described above with regard to a dual coaxial waveguide arrangement, and operate in a similar manner.

According to a further aspect of the present invention, there is provided a method of providing communication from at least two separate frequency bands in a single antenna feed device, said method comprising the steps of, providing a first central waveguide adapted to receive and/or transmit over a first frequency band, providing a second waveguide surrounding said first waveguide and coaxial with said first waveguide for receiving and/or transmitting at a second frequency band, said second frequency band being lower in frequency than said first frequency band, exciting said first waveguide by at least a single probe disposed in said waveguide to create a uniform field within said first waveguide, and exciting said second waveguide by feeding incident radiation into said outer waveguide in a direction orthogonal to the axis of said waveguide to create a uniform field within said outer coaxial waveguide.

The method may be used with a single or dual polarity system and may be used in any system requiring a simultaneous reception and/or transmission of signals in two separate frequency bands.

BRIEF DESCRIPTION OF THE DRAWINGS

These and other aspects of the present invention will become apparent from the following description when taken in combination with the accompanying drawings in which.

DETAILED DESCRIPTION OF THE PREFERRED EMBODIMENTS

Figure 1:
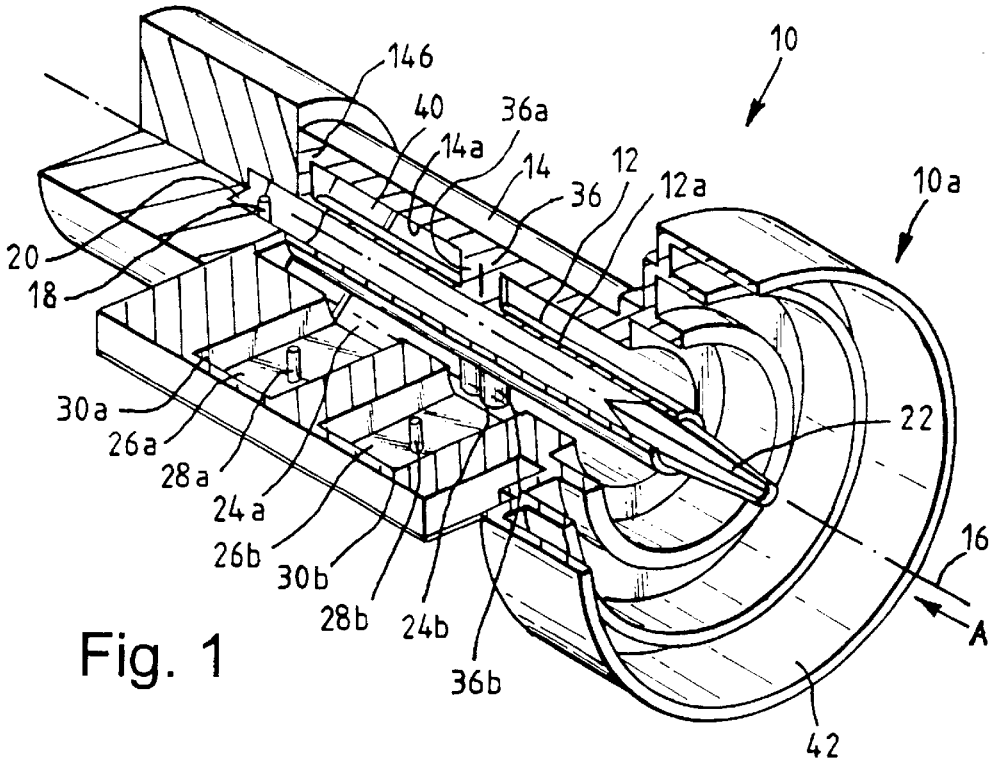
FIG. 1 is a perspective, and partly broken away, view of a coaxial waveguide in accordance with a preferred embodiment of the present invention.
Figure 2:
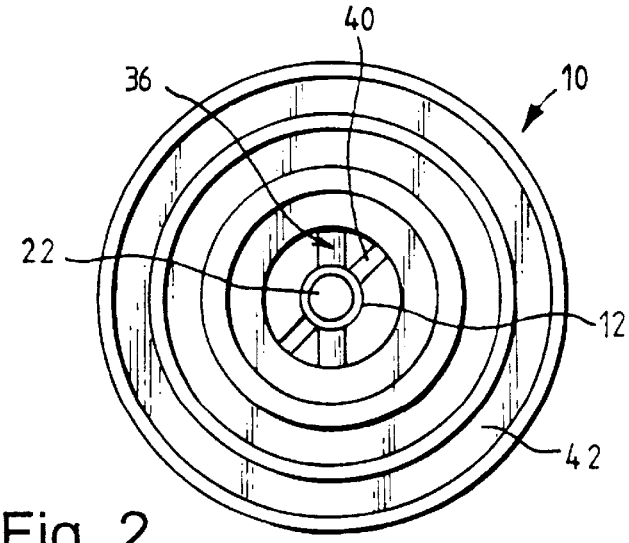
FIG. 2 is a front view of the coaxial waveguide taken in the direction of the arrow A.

Reference is first made to FIGS. 1 and 2 of the drawings which depicts a first embodiment of a multi-frequency antenna feed system, generally indicated by reference numeral 10. In this case, the multi-feed waveguide system consists of two circular coaxial waveguides; an inner circular waveguide 12 and an outer circular waveguide 14. Both waveguides are coaxial about longitudinal waveguide axis 16 (shown in broken outline). Circular central waveguide 12 is fed by a probe 18 at the rear of the waveguide with a short circuit 20 disposed behind the probe to provide a single polarity signal which operates in a frequency band of 29.5–30.0 GHz (band 2). At the front of the waveguide 12 a polyrod lens 22 is disposed for beam shaping to match up with a dish (not shown in the interests of clarity).

Waveguide 14 is disposed around central waveguide 12 and operates in a lower frequency band (band 1) from 10.7–12.75 GHz. Disposed in the wall of the waveguide 14 are two rectangular apertures 24*a*,24*b* which are fed by respective rectangular waveguides 26*a* and 26*b*. The apertures 24*a*,24*b* are sized to ensure optimum signal matching from waveguides 26*a*,26*b* to the waveguide 14. Rectangular waveguides 26*a*,26*b* and rectangular apertures 24*a*,24*b* are used to excite the coaxial guide 14 to set up a uniform field within the waveguide 14. The uniform field is first set up within the rectangular waveguides 26*a*,26*b* by using conventional probes 28*a*,28*b* with short circuits 30*a*,30*b* behind at a nominal quarter wavelength distance.

Figure 3A:
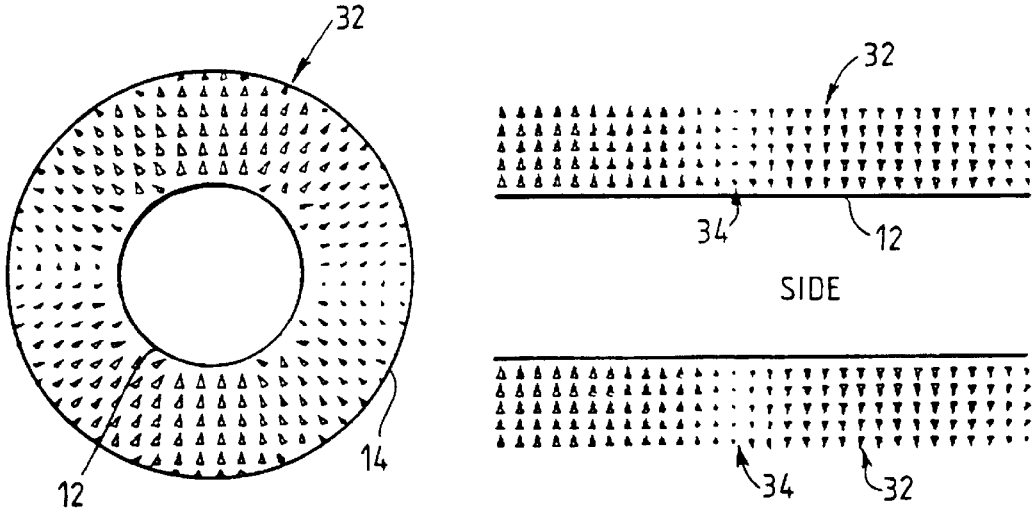
FIGS. 3*a* and 3*b* depict the field patterns set up in the coaxial waveguide shown in FIGS. 1 and 2 when the guide is excited by rectangular apertures in the side of the outer waveguide.
Figure 3B:
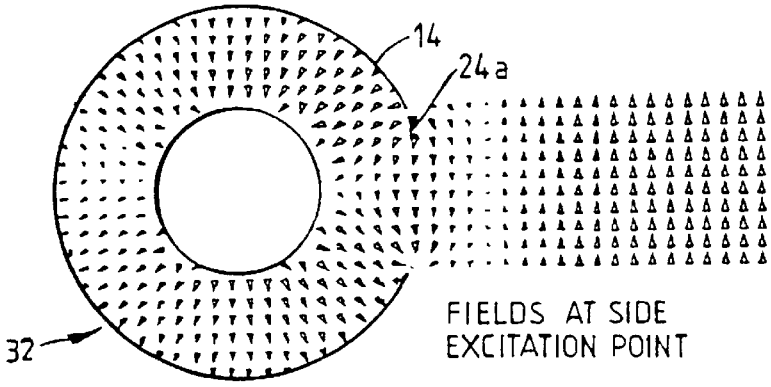

Reference is now made to FIGS. 3*a* and 3*b* which show the uniform field pattern set up in the coaxial waveguide when the guide is excited by the rectangular apertures 24*a*,24*b* in the side of the waveguide 14. The side view shows that there is no phase difference between the top and bottom of the waveguide 14 and the front view shows that the field 32 and phase shifts 34 are substantially uniform around the waveguide 14. The uniform field 32 set up in the coaxial waveguide is treated in the same way as the field in the central waveguide 12.

Turning back to FIGS. 1 and 2, it will be seen that in the coaxial guide 14, between the two rectangular aperture feeds 24*a*,24*b*, an isolation bar, generally indicated by reference numeral 36, is disposed between the outer surface 12*a* of the inner waveguide 12 and the inner surface 14*a* of the outer waveguide 14 in a plane which is orthogonal to the plane of the two rectangular waveguides 26*a*,26*b*. The isolation bar 36 in fact consists of two isolation bars 36*a* and 36*b* disposed adjacent each other. A twist plate 40 is disposed at the rear of the waveguide 14 and extends on each side of the central coaxial waveguide 12. The rear 14*b* of waveguide 14 is tapered as disclosed in applicant's co-pending application WO 98/10479 with the combination of the twist plate 40.

At the front of the coaxial waveguide 10*a* the waveguide 14 opens into a standard corrugated circular horn 42 which is designed to illuminate a circular dish (if a dish is used in the system). The polyrod lens 22 and horn 42 are adjusted so that the focal point for frequency band 1 and frequency band 2 is at the same point in the feed so that the same dish antenna is used.

Figure 4A:
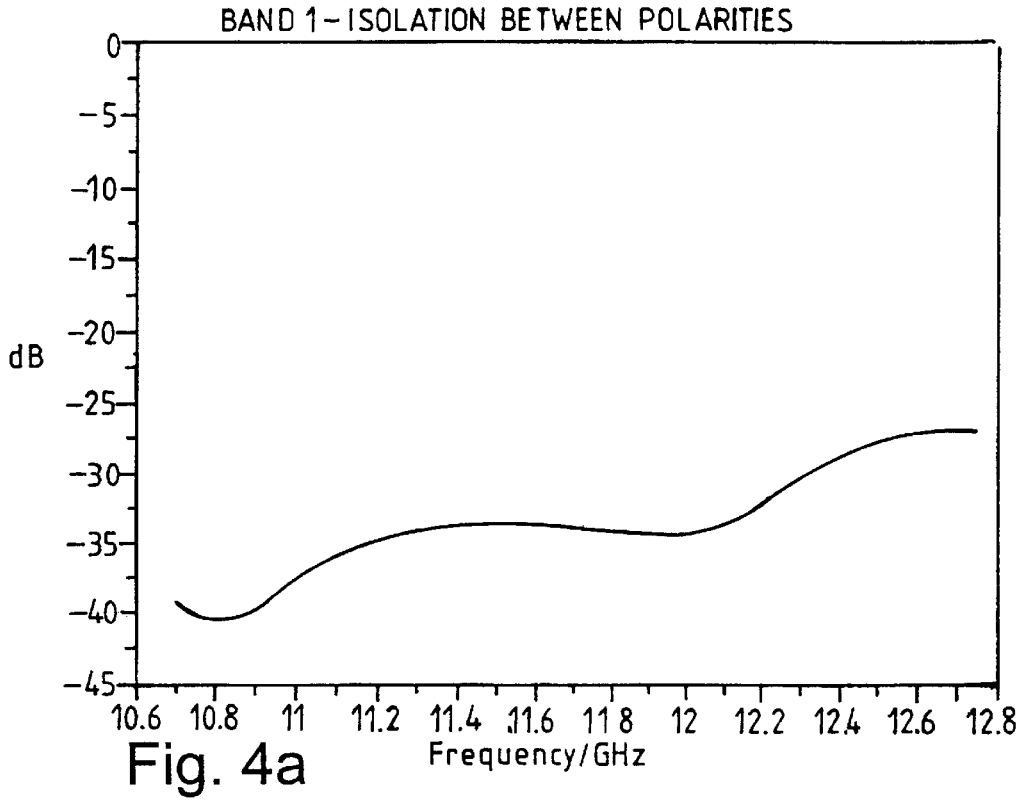
FIGS. 4*a* and 4*b* show the isolation between polarities and the received band match (return loss) respectively in the coaxial waveguide shown in FIGS. 1 and 2.
Figure 4B:
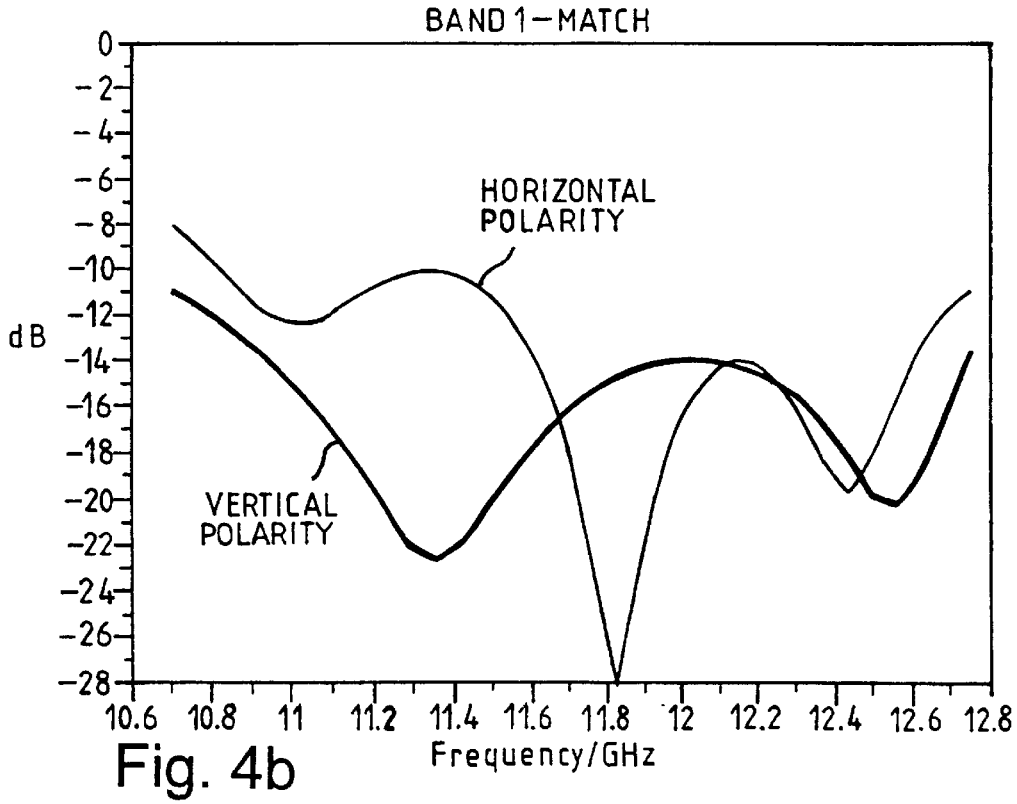
Figure 5:
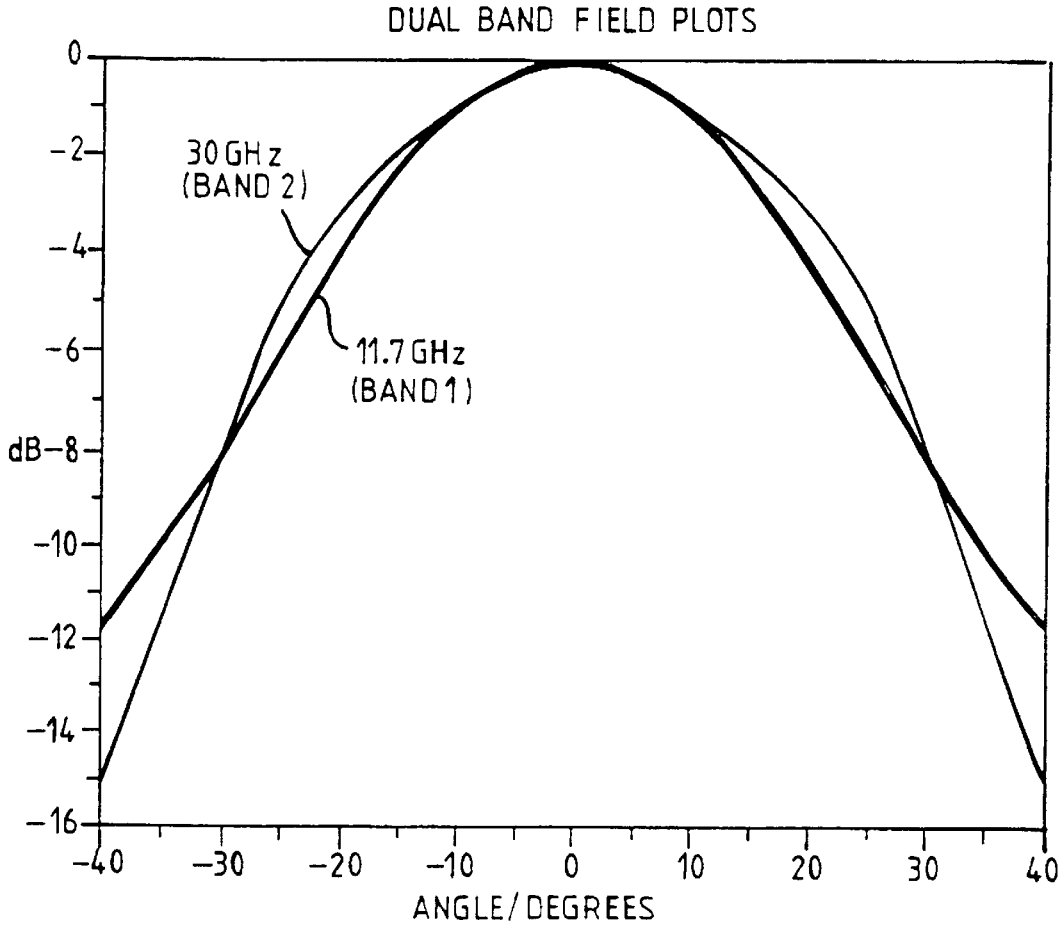
FIG. 5 shows the field plots for the band 1 and band 2 feeds for the outer and the inner waveguides respectively as shown in FIG. 1.

Reference is now made to FIGS. 4*a* and 4*b* of the drawings which depict graphs of isolation and match (return loss) in the coaxial waveguide 14 over the frequency range of band 1 (10.7–12.75 GHz). It will be seen that there is typically greater than 30 dB isolation between polarities. FIG. 5 shows the normal field plots for the band 1 feed and for the band 2 feed which are controlled by the polyrod lens 22 and the corrugated circular horn 42 respectively.

Figure 6:
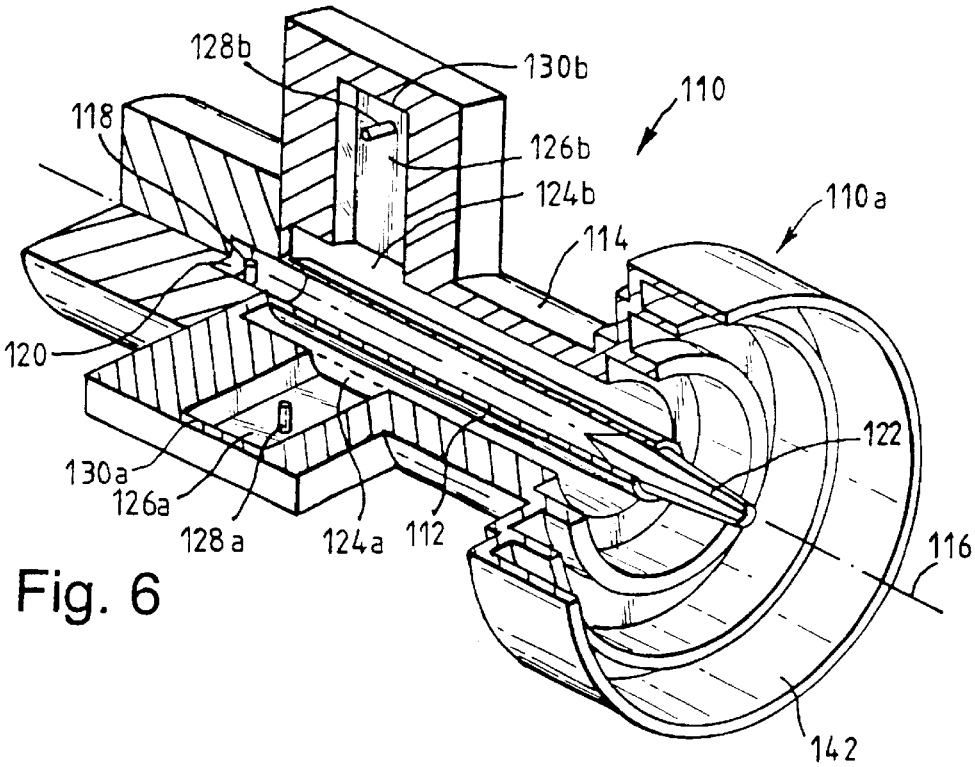
FIG. 6 depicts a second embodiment of a dual coaxial waveguide similar to that shown in FIG. 1 in which the side feeds to the outer coaxial waveguide are orthogonal to each other.

Reference is now made to FIG. 6 of the drawings which depicts a dual frequency antenna feed in accordance with a second embodiment of the present invention in which like numerals refer to like parts but with 100 added. The structure is essentially the same as that shown in FIG. 1 except that the rectangular waveguides 126*a*,126*b* feed the coaxial waveguide 114 in orthogonal planes, thereby avoiding the need for a twist plate at the rear of the waveguide 114. This arrangement works satisfactorily but an orthogonal arrangement of the waveguides 126*a*,126*b* makes it more difficult to feed both polarities in the coaxial waveguide 114 from the same circuit board and, consequently, the arrangement in FIG. 1 is preferred.

Figure 7:
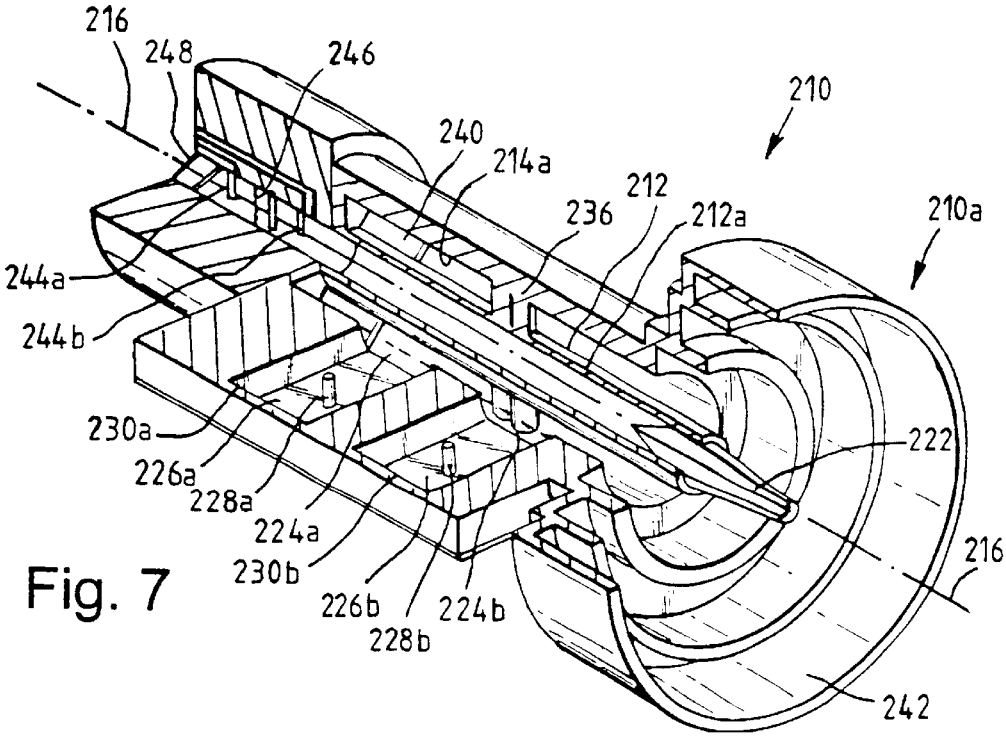
FIG. 7 depicts a third embodiment of a dual coaxial waveguide similar to that shown in FIG. 1 in which the inner waveguide provides a dual polarity system.

FIG. 7 depicts a third embodiment of the invention to the structure shown in FIG. 1 in which like numerals denote like parts but with 200 added. In this case the inner central waveguide 212 has been modified to provide a dual polarity system. Reference is made to the applicant's co-pending European Patent No. 0611488 and in this case it will be seen that the waveguide 212 has two spaced probes 244*a*,244*b* which are disposed on either side of a central isolation bar 246. The probes, the isolation bar and the twist plate are disposed rearward of the end of the coaxial waveguide 214. A twist plate 248 is disposed at the rear of the waveguide so that the waveguide 212 operates substantially as described in applicant's corresponding European Patent Application 0611488 to provide a dual polarity system.

Figure 8:
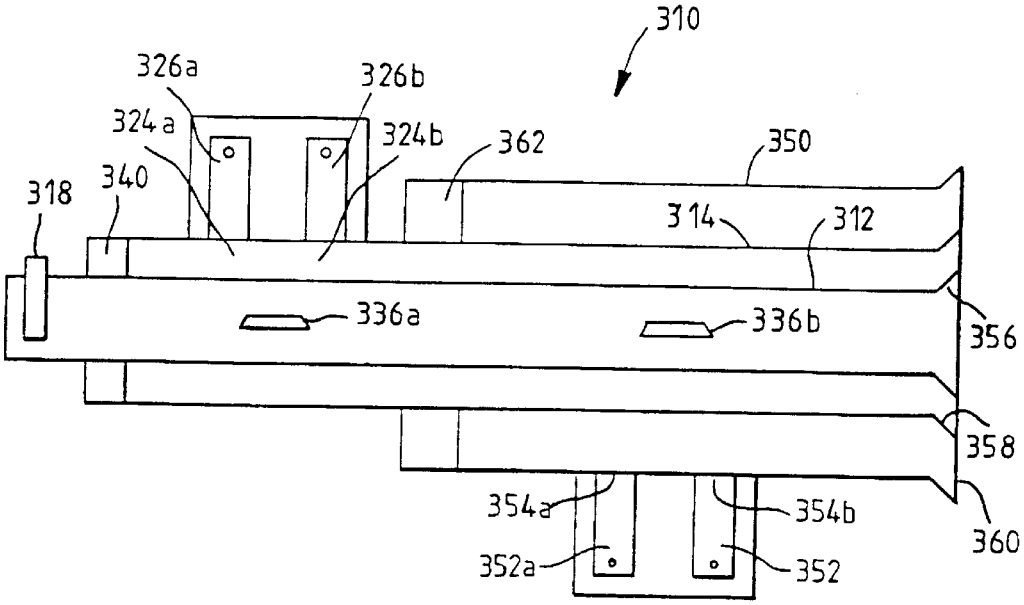
FIG. 8 depicts a diagrammatic sectional view of a fourth embodiment of a coaxial waveguide for providing a triple frequency band system but configured with a central waveguide and two outer coaxial waveguides.

Reference is now made to FIG. 8 of the drawings which depicts a diagrammatic section view of a fourth embodiment of multi-frequency antenna feed in accordance with the present invention in which like numerals refer to like parts but with the numeral 300 added. In this case, a triple waveguide antenna feed 310 is provided. A central waveguide 312 provides a first high frequency band 1 and a first outer coaxial waveguide 314 to provide a second low frequency band 2. Isolation plates 336*a*,336*b* are disposed in coaxial waveguide 314 and 350 respectively. Surrounding the waveguide 314 is a third outer waveguide, generally indicated by reference numeral 350, for providing the lowest frequency band 3. The inner waveguide 312 is excited by a single probe feed point 318 as in the first embodiment and the waveguide 314 is excited by rectangular waveguides 326*a*,326*b* which terminate in rectangular apertures 324*a*, 324*b* in the waveguide wall to provide the uniform field pattern as shown in FIG. 3. Similarly, the outer waveguide 350 is coupled to rectangular waveguides 352*a*,352*b* which terminate in rectangular apertures 354*a*,354*b* in the waveguide wall to also excite a uniform field within the coaxial waveguide 350, substantially identical to that shown in FIGS. 3*a* and 3*b* of the drawings. It will be seen from FIG. 8 that the three separate waveguides 312, 314 and 350 terminate in respective horns 356,358 and 360. Waveguides 314 and 350 also have twist plates 340,362 respectively at the other ends. The respective waveguide probes are coupled to circuit boards (not shown in the interests of clarity). The arrangement in FIG. 8 allows a single antenna feed to provide reception and/or transmission of three different frequency bands simultaneously.

Figure 9:
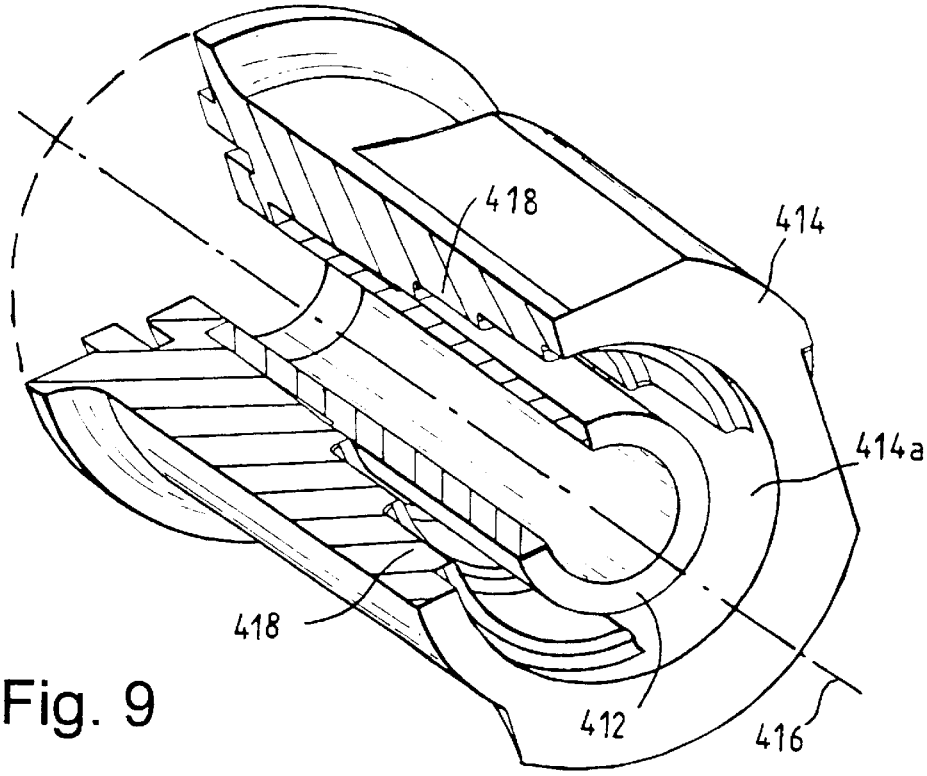
FIG. 9 is a perspective and partly-broken away view of part of an alternative embodiment of a coaxial waveguide with a tapered portion at the end of the waveguide to provide signal rotation.

Reference is now made to FIG. 9 which depicts a perspective and partly-broken away view of part of an alternative embodiment of a coaxial waveguide in accordance with the present invention. In this embodiment there are two circular coaxial waveguides; an inner circular waveguide 412 and an outer circular waveguide 414. As with the embodiment shown in FIG. 1, both waveguide are coaxial about longitudinal axis 416, shown in broken outline. Outer coaxial waveguide 414 is cast such that its interior surface 414*a* defines a tapered section, generally indicated by reference numeral 418, which is effectively disposed between the waveguides 412 and 414. This tapered waveguide section is used to perform signal rotation in the same manner as disclosed in applicant's copending published application WO92/22938 to change the phase of one of the signal vectors in the waveguide with respect to the other orthogonal vector and thus rotate the polarity of the signal.

Figure 10:
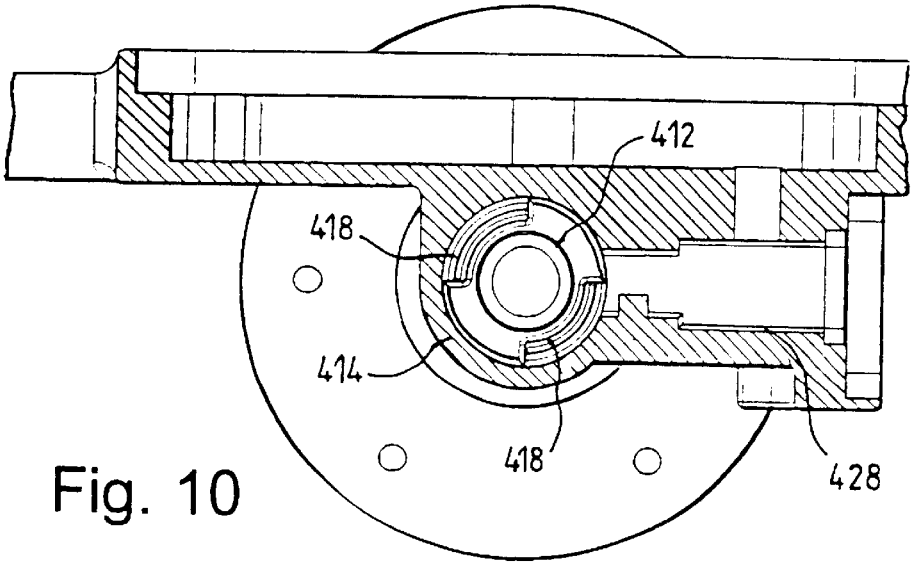
FIG. 10 is a cross-sectional view through a coaxial waveguide assembly with the waveguide of FIG. 9.

FIG. 10 is a cross-sectional view through the waveguide of FIG. 9 shown coupled to a side rectangular waveguide, generally indicated by reference numeral 420. It will be seen from this view that the tapering portions 418 converge towards the inner coaxial waveguide 412.

Figure 11:
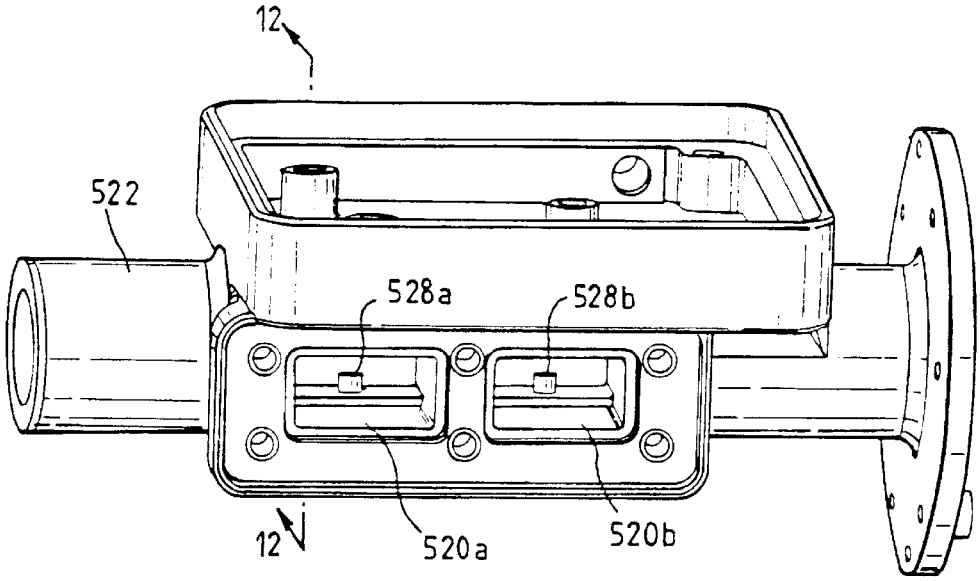
FIG. 11 is a perspective view of a coaxial waveguide assembly with posts disposed in the side waveguide.
Figure 12:
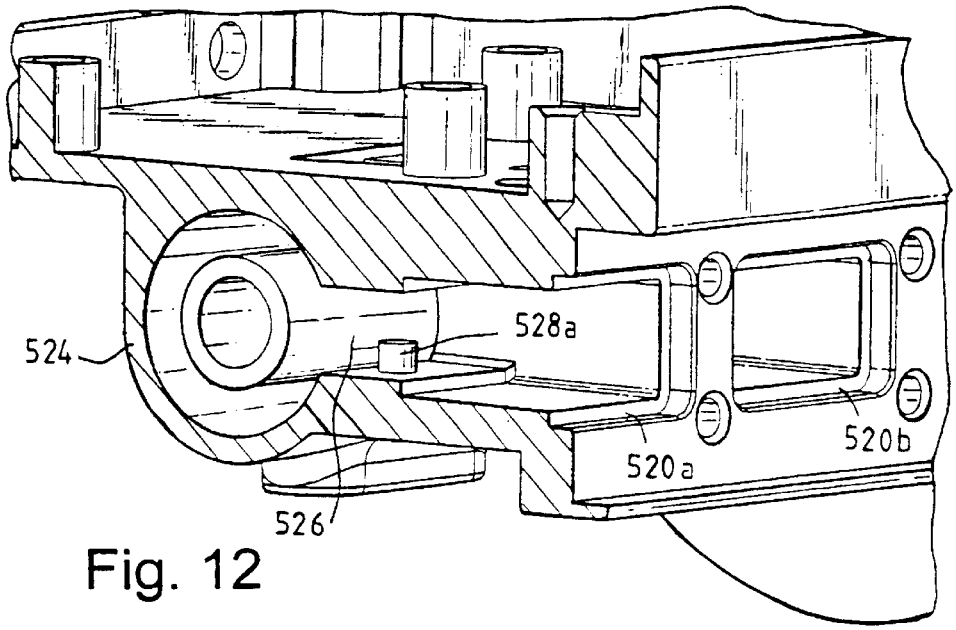
FIG. 12 is an enlarged sectional view taken on lines 12—12 of FIG. 11 showing the position of a tuning post in more detail.

Reference is now made to FIGS. 11 and 12 of the drawings which depict a further modification to the coaxial waveguide structures described above. In FIGS. 11 and 12 there are two rectangular side waveguides, generally indicated by reference numeral 520*a*,520*b*, shown coupled to a coaxial circular waveguide structure, generally indicated by reference numeral 522. As best seen in FIG. 12, each of the rectangular waveguides 520*a*,520*b* couples into an outer circular coaxial waveguide 524 via rectangular apertures 526, only one of which is shown in the interests of clarity. Disposed within the rectangular waveguides 520*a* and 520*b* are cylindrical tuning posts 528*a*,528*b* respectively which are used to improve the match of the system. The tuning posts are cast with the waveguide and extend into the waveguide approximately 2 mm. Alternatively, it is possible to replace the cast posts with tuning screws which can be adjusted so that the screws extend into the waveguide to the correct depth, which is approximately 2 mm, to improve the match of the system.

Figure 13:
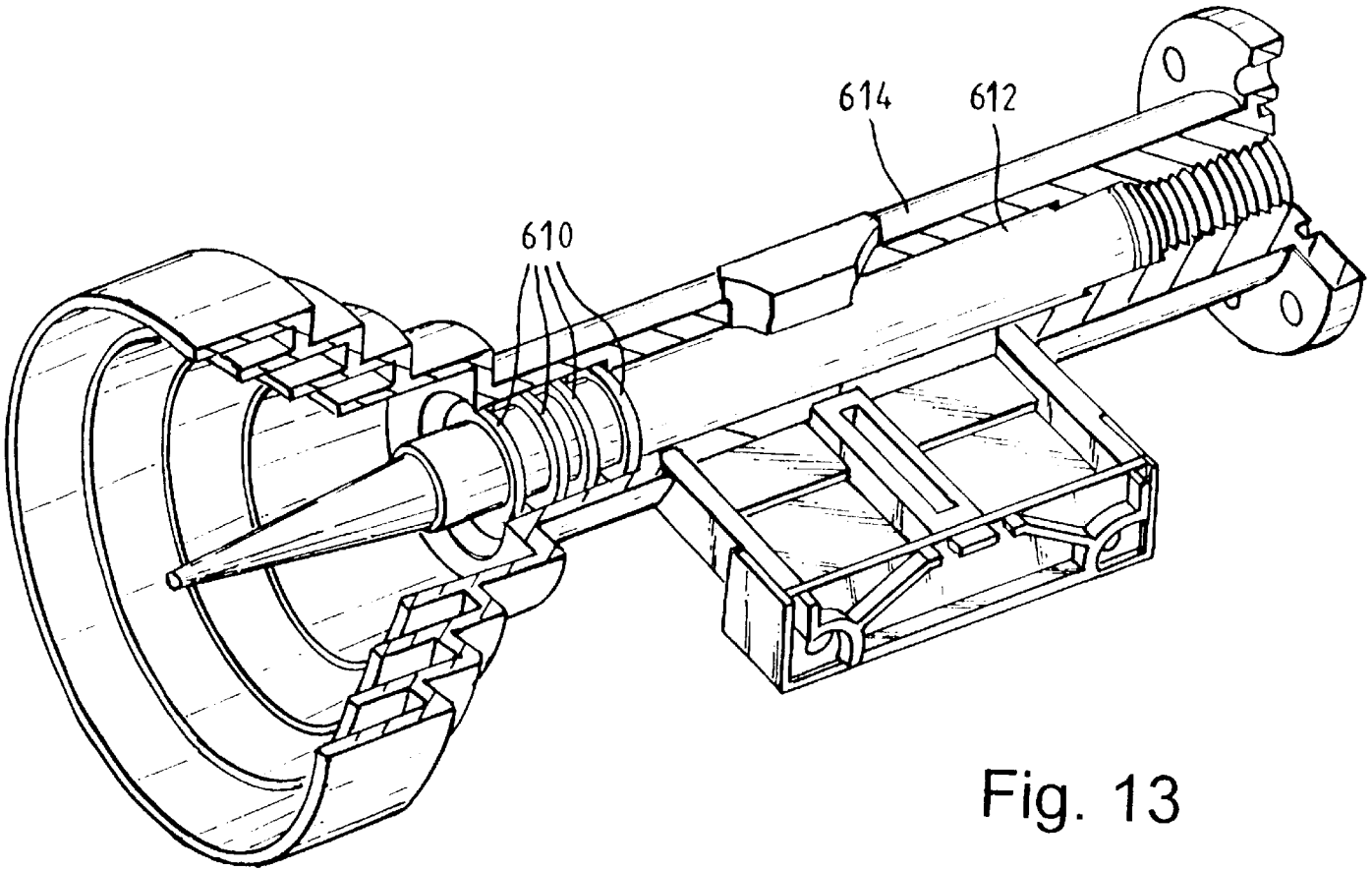
FIG. 13 is a perspective and partly-broken away view of a coaxial waveguide similar to that shown in FIG. 1 with a low-pass filter section in the coaxial waveguide.

Reference is now made to FIG. 13 of the drawings which depicts a perspective and partly broken away view of a coaxial waveguide similar to that shown in FIG. 1 but with a low pass filter section, generally indicated by reference numeral 610, disposed between the inner coaxial waveguide 612 and the outer coaxial waveguide 614, to improve the isolation between the Ka band transmit signal and the Ku band receive path.

Figure 14:
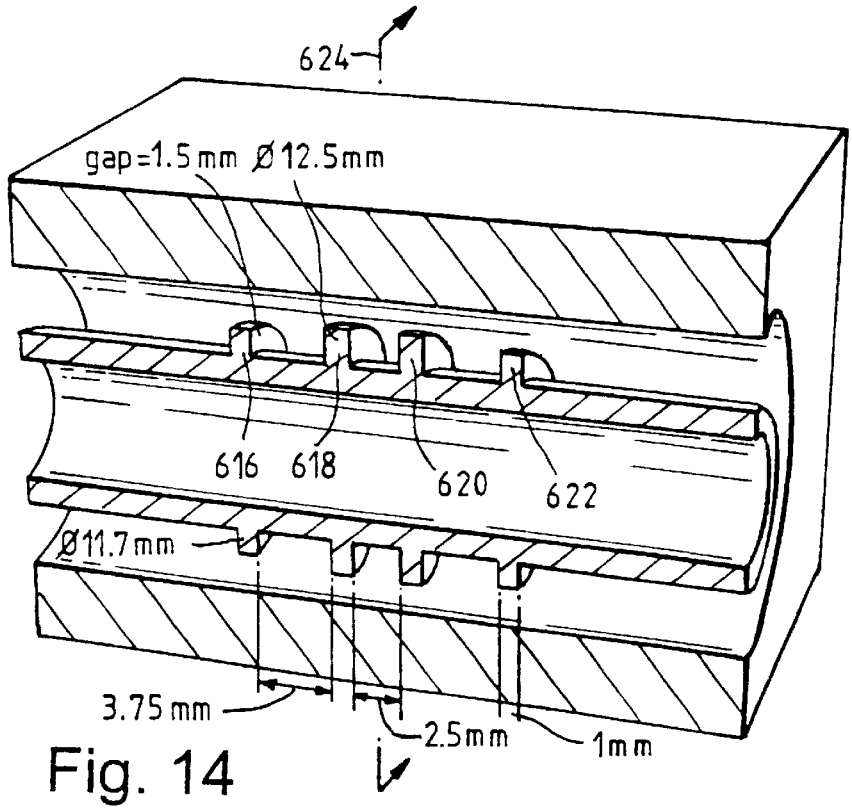
FIG. 14 is an enlarged cross-section of part of the coaxial waveguide shown in FIG. 13 with the filter section.
Figure 15:
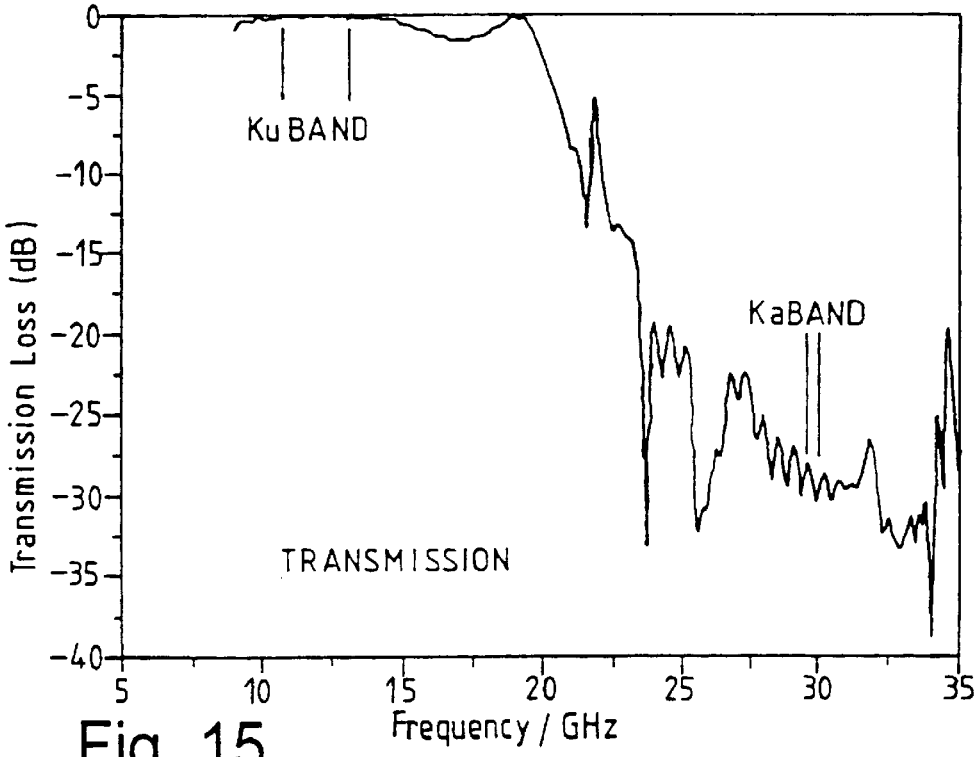
FIG. 15 is a graph of transmission loss versus frequency showing the response for the Ku band and Ka band of the filter shown in FIGS. 13 and 14.

Reference is now made to FIG. 14 which is an enlarged cross-section of part of the coaxial waveguide shown in FIG. 13 and from which it will be seen that the low pass filter section 610 is provided by four spaced ridges 616,618,620 and 622. Ridge pairs 616,618 and 620,622 are disposed symmetrically about plane 624 which is orthogonal to the main axis of the waveguide. This symmetrical arrangement has been found to provide a low pass filter which provides an improved transmission loss response, as shown in FIG. 15 which is a graph of transmission loss (dB) versus frequency from which it can be seen that there is minimal transmission loss for the Ku band (10.7 to 12.2 GHz), whereas the Ka band signal has been rejected showing a transmission loss of approximately 28 dB. It will be understood that the filter may take the form of any number of ridges on the coaxial inner tube and the size and spacing of the ridges can be varied as appropriate, although there must be a gap between the outermost surface of the ridges and the inner surface of outer coaxial waveguide.

A further modification relates to the construction of the coaxial waveguide tubes. In the embodiments hereinbefore described, the inner 30 GHz waveguide tube is pressed into the base casting. In order to minimise gaps at the interface between the inner coaxial waveguide tube 12*a*, 616 etc. and the base casting at the end of the Ku band coaxial waveguide 14,614 etc., a conductive resilient gasket may be disposed at the interface between the inner and outer coaxial waveguide to take up any gaps arising due to temperature effects or subsequent movement of the 30 GHz waveguide inner coaxial tube with respect to the outer tube and base casting. One suitable material for the conductive resilient gasket is Xyshield (RFI Shielding Limited, U.K.) which is applied directly to the outer surface of the waveguide tube 12, 612 etc. prior to pressing the two parts together.

It will be appreciated that various modifications may be made to the embodiments hereinbefore described without departing from the scope of the invention. For example, although the side feeds hereinbefore disclosed are rectangular and terminate in rectangular apertures in the waveguide walls, other waveguide cross-sections such as an elliptical cross-section may be used, such that a field can be set up by an aperture in one polarity but be transparent to the field in the orthogonal polarity. A circular guide could be used as a side feed with a transition from the circular guide to a rectangular or elliptical guide before the side section is fed in to the corresponding rectangular or elliptical aperture in the coaxial guide. Posts to improve matching may be disposed in any of the side feeds.

Furthermore, although the waveguides hereinbefore described are circular, it will be understood that square waveguides may be used, such that the inner waveguide is square is located within a larger outer square waveguide. Another alternative arrangement may be a square waveguide within a circular guide. It will also be understood that elliptical guide cross-sections could also be used.

With reference to the embodiments shown in FIGS. 1, 7 and 8 of the drawings, it will be understood that a single isolation bar may be used instead of the two isolation bars next to each other, although isolation between polarities may be somewhat reduced. Also an isolation plate may be used as shown in FIG. 8. Furthermore, the twist plate which is disposed at the back of the coaxial waveguide could take any suitable form, such as those disclosed in applicant's published International Patent Application No. WO 96/28857, that is the twist plate may have a straight leading edge, may be stepped or a combination of a plate and a tapered waveguide, such as, for example, the waveguide described above. Furthermore, it will be understood that the horns shown in the embodiments may be replaced by different types of horns such as a straight-sided conical horn or a cross feed as disclosed in applicant's copending published patent application No. WO 99/63624. It will also be understood that the size of the apertures into the waveguide can be adjusted to achieve the best match between the feed waveguides and the coaxial waveguide. The second frequency band of the outer waveguide is generally lower than the first frequency band of the central waveguide. However, the central waveguide may be dielectrically loaded to provide a lower frequency band in accordance with techniques well known to persons skilled in the art.

It will also be appreciated that there are numerous manufacturing techniques which could be used to make this feed system. The whole system could be cast, or cast in sections, and assembled from a mixture of casting components and machined components as required. It will be understood that the central guide may be an extruded pipe. It will also be possible to use this system for circularly polarised signals by disposing appropriate circular to linear translators in each waveguide. The invention could also be used for dual band wireless links. In this case it may not be necessary for the phase center of the two feeds to be at the same point. The invention has inherently good isolation between bands because each band has a separate waveguide. The use of the filter section improves the isolation between the Ku and Ka bands. This is particularly important in a transmit/receive system where there is a possibility of the transmitted signal saturating the input of the receive signal chain. In the filter section it is desirable, but not essential, that the ridges are symmetrical about a plane orthogonal to the waveguide axis. Any suitable number of ridges may be used.

The principal advantage of the present invention is that it allows multiple frequency bands to be used in a single antenna feed. This permits two-way communication via a satellite by using two or more frequency bands provided by at least two coaxial waveguides. The feed has application in any system requiring simultaneous reception or transmission of signals in two or more separate frequency bands and may be used in other frequency bands by the correct selection of the waveguide diameters. A further advantage is that the waveguides are incorporated in a single feed and can be used with a variety of circular and non-circular horns or lenses to illuminate different types of dishes and adjusted so that the focal point for each frequency band is at the same point in the feed for the same dish. The invention can be used with single or dual polarity systems.

What is claimed is:

1. A single antenna feed structure having a first central waveguide operating at a first frequency band and at least one outer waveguide substantially coaxial with the central waveguide and operating at a second frequency band, said first waveguide being excited by excitation means disposed in said waveguide, and said second waveguide being excited by radiation from a non-circular waveguide feed structure disposed orthogonally to the longitudinal axis of the outer waveguide and including a first feed for horizontally polarized signals and a second feed for vertically polarized signals so as to set up respective horizontally and vertically polarized fields in said at least one outer waveguide and said feed structure having an isolation bar disposed in the outer waveguide and between an outer surface of the inner central waveguide and an inner surface of the outer coaxial waveguide on both sides of the inner waveguide and in a plane orthogonal to the first and second non-circular waveguides, and signal rotation means disposed in said outer waveguide for rotating the polarized signals in said outer waveguide.

2. An antenna feed as claimed in claim 1 wherein said inner waveguide receives horizontal and vertically polarized signals.

3. An antenna feed as claimed in claim 1 wherein first frequency band is higher than the second frequency band.

4. An antenna feed as claimed in claim 1 wherein the first frequency band is lower when the central waveguide is dielectrically loaded.

5. An antenna feed as claimed in claim 1 wherein a low pass filter is disposed between the inner and outer waveguide structures to improve signal isolation between said first and said second frequency band.

6. An antenna feed as claimed in claim 5 wherein said low pass filter comprises a plurality of spaced ridges disposed between the inner and outer coaxial waveguides.

7. An antenna feed as claimed in claim 6 wherein there are an even number of ridges disposed symmetrically about a plane orthogonal to said waveguide axis.

8. An antenna feed as claimed in claim 6 wherein there are an odd number of ridges disposed symmetrically about a plane orthogonal to said waveguide axis.

9. An antenna feed as claimed in claim 1 wherein the excitation means is a probe in said central waveguide.

10. An antenna feed as claimed in claim 1 wherein the excitation means is selected from the group consisting of: a slot radiator, a patch radiator, a dipole, and a wire loop excitation probe and is disposed in said central waveguide.

11. An antenna feed as claimed in claim 1 wherein said central waveguide is fed by said probe and has a short circuit behind said probe for providing a single polarity system.

12. An antenna feed as claimed in claim 1 wherein said central waveguide has two spaced probes separated by an isolation bar, and a twist plate at the end of said waveguide for providing a dual polarity system.

13. An antenna feed as claimed in claim 1 wherein the at least one outer waveguide is coupled to at least one rectangular waveguide to define a rectangular aperture into the coaxial guide.

14. An antenna feed as claimed in claim 13 wherein the field set up in the at least one outer waveguide is achieved by using a probe with a short circuit behind the probe at a nominal distance of a quarter wavelength, such that the rectangular aperture feed sets up a uniform field in the at least one outer waveguide.

15. An antenna feed as claimed in claim 13 wherein two rectangular feed sections are used, one for horizontal polarised signals and one for vertical polarised signals, said feeds being coplanarly disposed in a plane parallel to the waveguide axis.

16. An antenna feed as claimed in claim 13 wherein two rectangular feed sections are used, one for horizontal polarised signals and one for vertical polarised signals, said rectangular feed sections being oriented in orthogonal directions.

17. An antenna feed as claimed in claim 15 wherein two in-line elliptical feed sections are used, one elliptical feed section for horizontal signals and the other elliptical feed section for vertical signals.

18. An antenna feed as claimed in claim 13 wherein at least one isolation bar is disposed in the outer waveguide and between the outer surface of the inner central waveguide and the inner surface of the outer coaxial waveguide on both sides of the inner waveguide and in a plane orthogonal to the at least one rectangular waveguide.

19. An antenna feed as claimed in claim 18 wherein a single isolation bar is used.

20. An antenna feed as claimed in claim 18 wherein said at least one isolation bar is an isolation plate.

21. An antenna feed as claimed in claim 18 wherein a twist plate oriented at 45° to the isolation bar is disposed at the back of the coaxial waveguide and extends on each side of the central waveguide.

22. An antenna feed as claimed in claim 1 wherein an elliptical waveguide is coupled to said second outer waveguide and defines with said second waveguide an elliptical aperture in the wall of said outer waveguide.

23. An antenna feed as claimed in claim 22 wherein two elliptical feed sections oriented in orthogonal directions are used, one elliptical feed section for horizontal signals and one elliptical feed section for vertical signals.

24. An antenna feed as claimed in claim 1 wherein each of the non-circular waveguides has a tuning post disposed therein to improve the match between the side feed waveguide and the coaxial waveguide.

25. An antenna feed as claimed in claim 24 wherein each tuning post is cast with the waveguide.

26. An antenna feed as claimed in claim 24 wherein the tuning posts are separate from and adjustable relative to the waveguide to improve the match.

27. An antenna feed as claimed in claim 26 wherein the separate tuning posts comprise turning screws which are adjustable relative to the waveguide.

28. An antenna feed as claimed in claim 1 wherein the first central waveguide includes a polyrod lens for beam shaping to match up with a dish antenna.

29. An antenna feed as claimed in claim 1 wherein a small feed horn is used with the central waveguide.

30. An antenna feed as claimed in claim 29 wherein the horn is positioned so that the focal point for each frequency band is at the same point in the feed.

31. An antenna feed as claimed in claim 1 wherein the outer coaxial waveguide opens out into a horn feed for illuminating a dish antenna.

32. An antenna feed as claimed in claim 1 further comprising at least one horn in the feed positioned so that the focal point for each frequency band is at the same point in the feed.

33. An antenna feed as claimed in claim 32 wherein the at least one horn is corrugated.

34. An antenna feed as claimed in claim 32 wherein the at least one horn has straight sides.

35. An antenna feed as claimed in claim 1 wherein the outer coaxial waveguide is coupled to a cross-feed.

36. An antenna feed as claimed in claim 1 wherein a tapered waveguide is used to provide signal rotation.

37. An antenna feed as claimed in claim 36 wherein the tapered waveguide comprises cast stepped portions disposed in the inner surface of the outer waveguide, said portions converging towards said inner coaxial waveguide when fitted into said outer coaxial waveguide in the antenna feed structure.

38. An antenna feed as claimed in claim 36 wherein two stepped portions are cast into said outer waveguide.

39. An antenna feed as claimed in claim 38 wherein the inner tube has an outer portion coated with a conductive elastomer prior to press-fitting to minimise any gaps between said inner tube and a base casting at the end of the waveguide assembly.

40. An antenna feed as claimed in claim 38 wherein said conductive elastomer is a gasket disposed around the inner coaxial waveguide tube.

41. An antenna feed as claimed in claim 39 wherein the conductive elastomer is disposed at the leading end of said inner tube.

42. An antenna feed as claimed in claim 1 wherein said inner coaxial waveguide tube is press-fitted into said outer tube.

43. A method of providing communication from at least two separate frequency bands in a single antenna feed device, said method comprising the steps of, providing a first central waveguide adapted for at least one of receiving and transmitting over a first frequency band, providing a second waveguide surrounding said first waveguide and coaxial with said first waveguide for at least one of receiving and/or transmitting at a second frequency band, said second frequency band being lower than said first frequency band, providing a feed structure disposed orthogonally to the longitudinal axis of the second waveguide and including a first feed for horizontally polarized signals and a second feed for vertically polarized signals so as to set up respective horizontally and vertically polarized fields in said second waveguide, said feed structure having an isolation bar disposed in the second waveguide and between an outer surface of the first waveguide and an inner surface of the second waveguide on both sides of the first waveguide and in a plane orthogonal to the first and second waveguides, providing signal rotation means disposed in said second waveguide for rotating the polarized signals in said second waveguide, exciting said first waveguide by at least a single probe disposed in said waveguide to create a uniform field within said first waveguide, and exciting said second waveguide by feeding incident radiation into said outer waveguide in a direction orthogonal to the axis of said waveguide to create a uniform field within said outer coaxial waveguide.

44. A multi-frequency band receive/transmit antenna feed comprising a first central waveguide operating at a first frequency band and at least one outer waveguide substantially coaxial with the central waveguide and operating at a second frequency band, said first waveguide being excited by excitation means disposed in said waveguide, and said outer waveguide being excited by radiation from a non-circular waveguide feed structure disposed orthogonally to the longitudinal axis of the outer waveguide and including a first feed for horizontally polarized signals and a second feed for vertically polarized signals so as to set up respective horizontally and vertically polarized fields in said at least one outer coaxial waveguide, and said feed structure having an isolation bar disposed in the outer waveguide and between an outer surface of the inner waveguide and an inner surface of the outer waveguide on both sides of the inner waveguide and in a plane orthogonal to the first and second waveguides, and a second signal rotation means disposed in said outer waveguide for rotating the polarized signals in said outer waveguide, whereby said antenna feed can one of receive signals in said different frequency bands, and receive/transmit signals in said different frequency bands.

* * * * *